US011878255B2

(12) United States Patent
Schlapik et al.

(10) Patent No.: US 11,878,255 B2
(45) Date of Patent: Jan. 23, 2024

(54) PUZZLE KITS

(71) Applicant: Kevin D. Schlapik, Dania Beach, FL (US)

(72) Inventors: Kevin D. Schlapik, Fort Lauderdale, FL (US); Yu Sheng, Guandong (CN)

(73) Assignee: Kevin Schlapi, Dania Beach, FL (US)

( * ) Notice: Subject to any disclaimer, the term of this patent is extended or adjusted under 35 U.S.C. 154(b) by 0 days.

(21) Appl. No.: 18/450,026

(22) Filed: Aug. 15, 2023

(65) Prior Publication Data

US 2023/0381636 A1 Nov. 30, 2023

Related U.S. Application Data

(63) Continuation of application No. PCT/US2023/060411, filed on Jan. 10, 2023.

(60) Provisional application No. 63/298,722, filed on Jan. 12, 2022.

(51) Int. Cl.
*A63F 9/12* (2006.01)

(52) U.S. Cl.
CPC .... *A63F 9/1208* (2013.01); *A63F 2009/1212* (2013.01)

(58) Field of Classification Search
CPC ..... A63F 9/1208; A63F 2009/1212
See application file for complete search history.

(56) References Cited

U.S. PATENT DOCUMENTS

| | | | |
|---|---|---|---|
| 1,997,022 | A | 4/1935 | Stalker |
| 2,570,625 | A | 10/1951 | Zimmerman et al. |
| 2,839,841 | A | 6/1958 | Berry |
| 2,992,829 | A | 7/1961 | Hopkins |
| 3,095,668 | A | 7/1963 | Dorsett |
| 3,254,440 | A | 6/1966 | Duggar |
| 3,618,954 | A | 11/1971 | Murff |
| 3,645,535 | A | 2/1972 | Alexander |
| 3,659,360 | A | 5/1972 | Walter |
| 3,662,486 | A | 5/1972 | Freedman |
| 3,746,345 | A | 7/1973 | Palazzolo |
| 3,831,503 | A | 8/1974 | Tranquillitsky |

(Continued)

FOREIGN PATENT DOCUMENTS

| | | | |
|---|---|---|---|
| DE | 4200184 | A1 | 8/1992 |
| DE | 19617526 | A1 | 5/1997 |

(Continued)

OTHER PUBLICATIONS

International Search Report and Written Opinion of the International Searching Authority dated May 25, 2023, issued in the corresponding International Application No. PCT/US23/60411, filed Jan. 10, 2023, 13 pages.

(Continued)

*Primary Examiner* — Steven B Wong

(74) *Attorney, Agent, or Firm* — IPkey PLLC; John W. Zerr

(57) ABSTRACT

Puzzle kits include a first puzzle and a second puzzle, each of which is formed of a plurality of polyhedral modules, or polyhedrons, connected by hinges in a continuous loop. Each polyhedron includes four faces, six edges, and at least one magnet disposed adjacent to at least one face. Magnetically stabilized assemblies of the first puzzle and the second puzzle form at least a convex polyhedrons, such as a cube.

19 Claims, 7 Drawing Sheets

(56) References Cited

U.S. PATENT DOCUMENTS

| | | | | |
|---|---|---|---|---|
| 3,916,559 | A | 11/1975 | Flowerday | |
| 4,020,205 | A | 4/1977 | Haselbauer | |
| D246,544 | S | 11/1977 | Brinkley | |
| 4,063,725 | A | 12/1977 | Snyder | |
| D248,987 | S | 8/1978 | Paschal | |
| 4,142,321 | A | 3/1979 | Coppa | |
| 4,227,334 | A | 10/1980 | Hooker | |
| 4,258,479 | A * | 3/1981 | Roane | A63H 33/046 434/211 |
| D264,361 | S | 5/1982 | Meffert | |
| 4,334,870 | A | 6/1982 | Roane | |
| 4,334,871 | A | 6/1982 | Roane | |
| 4,377,916 | A | 3/1983 | Komiya | |
| 4,392,323 | A | 7/1983 | Rubik | |
| 4,484,406 | A | 11/1984 | Matsumoto et al. | |
| 4,722,712 | A | 2/1988 | Mckenna | |
| 4,886,273 | A | 12/1989 | Unger | |
| 4,993,989 | A | 2/1991 | Gidwani | |
| 5,009,625 | A | 4/1991 | Longuet-Higgins | |
| D321,671 | S | 11/1991 | Goonen | |
| D324,891 | S | 3/1992 | Unknown | |
| 5,108,100 | A | 4/1992 | Essebaggers et al. | |
| 5,192,077 | A | 3/1993 | Caicedo | |
| 5,193,809 | A | 3/1993 | Hrsel et al. | |
| 5,199,711 | A | 4/1993 | Pataki et al. | |
| 5,249,966 | A | 10/1993 | Hiigli | |
| 5,299,804 | A | 4/1994 | Stevens | |
| 5,322,284 | A | 6/1994 | El-Agamawi | |
| 5,338,034 | A | 8/1994 | Asch | |
| 5,429,966 | A | 7/1995 | Wu et al. | |
| D365,295 | S | 12/1995 | Kandampully | |
| 5,630,587 | A | 5/1997 | Zlotsky | |
| 5,651,715 | A | 7/1997 | Shedelbower | |
| 5,660,387 | A * | 8/1997 | Stokes | G09B 23/04 434/211 |
| 5,746,638 | A | 5/1998 | Shiraishi | |
| 5,762,529 | A | 6/1998 | Nizza | |
| 6,017,220 | A | 1/2000 | Snelson | |
| 6,024,626 | A | 2/2000 | Mendelsohn | |
| 6,196,544 | B1 | 3/2001 | Rachofsky | |
| 6,257,574 | B1 | 7/2001 | Evans | |
| 6,264,199 | B1 | 7/2001 | Schaedel | |
| 6,386,541 | B1 | 5/2002 | Cornelius et al. | |
| 6,467,205 | B1 | 10/2002 | Flagg et al. | |
| D475,094 | S | 5/2003 | Ko | |
| 6,796,560 | B1 | 9/2004 | Cornelius et al. | |
| D617,850 | S | 6/2010 | Langin-Hooper | |
| 8,061,713 | B2 | 11/2011 | Cook | |
| 8,087,671 | B2 | 1/2012 | Houlis | |
| 8,157,608 | B1 | 4/2012 | Stapleton | |
| 9,662,592 | B2 | 5/2017 | Haughey et al. | |
| 10,569,185 | B2 | 2/2020 | Hoenigschmid | |
| 10,918,964 | B2 | 2/2021 | Hoenigschmid | |
| 11,318,369 | B2 * | 5/2022 | Hung | A63F 9/1208 |
| 11,318,370 | B2 * | 5/2022 | Guenzani | A63F 9/1208 |
| 11,697,058 | B1 * | 7/2023 | Hoenigschmid | A63H 33/046 273/155 |
| 2007/0037469 | A1 | 2/2007 | Yoon | |
| 2008/0224665 | A1 | 9/2008 | Matsumoto et al. | |
| 2008/0274665 | A1 | 11/2008 | Cheng | |
| 2010/0038850 | A1 | 2/2010 | Tenorio | |
| 2010/0087119 | A1 | 4/2010 | Vicentelli | |
| 2010/0120322 | A1 | 5/2010 | Vicentelli | |
| 2010/0225057 | A1 | 9/2010 | Akiyama et al. | |
| 2012/0049448 | A1 * | 3/2012 | Agamawi | A63F 9/1208 273/153 S |
| 2012/0164913 | A1 | 6/2012 | Pomeroy et al. | |
| 2014/0213139 | A1 | 7/2014 | Ferguson et al. | |
| 2014/0357151 | A1 | 12/2014 | Worley | |
| 2015/0065007 | A1 | 3/2015 | Klepper et al. | |
| 2016/0074765 | A1 | 3/2016 | Hoenigschmid | |
| 2016/0199749 | A1 | 7/2016 | Whittaker | |
| 2022/0047960 | A1 | 2/2022 | Hoenigschmid | |

FOREIGN PATENT DOCUMENTS

| | | | | |
|---|---|---|---|---|
| DE | 202014002837 | U | 6/2014 | |
| FR | 1582965 | A | 10/1969 | |
| FR | 2669550 | A1 | 5/1992 | |
| GB | 588842 | A | 6/1947 | |
| GB | 2064844 | A | 6/1981 | |
| GB | 2107200 | A | 4/1983 | |
| KR | 200454067 | Y1 | 6/2011 | |
| WO | WO-9211911 | A1 * | 7/1992 | A63F 9/088 |
| WO | 2013097872 | A1 | 7/2013 | |
| WO | 2014038735 | A1 | 3/2014 | |
| WO | 2015141927 | A1 | 9/2015 | |

OTHER PUBLICATIONS

"Transforming Yoshimoto Cube #2 Tutorial," YouTube, uploaded by Karagamii Oct. 8, 2020, https://www.youtube.com/watch?v=Ps9aB8Xw9e8.

* cited by examiner

PUZZLE KITS

CROSS-REFERENCE TO RELATED APPLICATIONS

This application is a continuation of International Application No. PCT/US23/60411, filed on Jan. 10, 2023, which claims the benefit of U.S. Provisional Patent Application No. 63/298,722, filed Jan. 12, 2022, the entire disclosures of which are hereby incorporated by reference.

TECHNICAL FIELD

The present disclosure relates to the field of toys and puzzles.

BACKGROUND

Puzzles have enjoyed cross-generational appeal as games, toys, teaching aids, therapy devices, and the like. Such puzzles may be configured between different geometric configurations as shown in, e.g., UK Patent Application No. GB 2,107,200 to Asano and U.S. Pat. No. 6,264,199 B1 to Schaedel. As taught in the prior art, the properties of any particular polyhedral puzzle are highly specific to the geometry and hinging arrangements of that specific puzzle. For example, the folding puzzle taught in Schaedel teaches a folding puzzle consisting of twenty-four identical isosceles tetrahedron bodies, each being formed of four triangular faces having angles of approximately 70.53°, 54.74°, and 54.74°. The tetrahedrons are joined to each other at their base (longest) edges and can be manipulated into a rhombic dodecahedron in "many different ways."

However, Schaedel does not teach any other geometry capable of achieving a rhombic dodecahedron in many different ways. Indeed, as one skilled in the art will appreciate, there are seemingly infinite different combinations of variables in such a puzzle, including: the number of faces and edges of the polyhedrons, the interior angles and edge lengths of the polyhedrons, the number of polyhedrons, whether all polyhedrons are identical or not, how the polyhedrons are ordered, the location of the hinges between the polyhedrons, and other variables.

Moreover, due to such seemingly infinite combinations of variables and the unpredictable results from changes in the interrelated variables, even minor variations of one variable can alter the properties of the overall puzzle, often in ways that are detrimental to the functionality of the puzzle itself.

Accordingly, there is a need for new puzzles having different geometries and exciting new properties.

SUMMARY

The present disclosure provides puzzle kits which include at least a first puzzle and a second puzzle. According to an aspect, each of the first puzzle and the second puzzle include a plurality of polyhedral modules, or polyhedrons, connected by hinges in a continuous loop. For each of the first puzzle and the second puzzle, each polyhedron of the plurality of polyhedrons has four faces and six edges. In some embodiments, each edge of the six edges has a relative side length of one unit, two units, the square root of two units (√(2) units), or the square root of three units (√(3) units). Each polyhedron of the plurality of polyhedrons has a plurality of magnets. In some embodiments, at least one, two, three, or four faces have at least one magnet of the plurality of magnets disposed adjacent thereto.

According to another aspect, a puzzle kit includes a first puzzle and a second puzzle. Each of the first puzzle and the second puzzle includes a plurality of polyhedrons connected by hinges in a continuous loop, and each polyhedron includes four faces and six edges, and at least one magnet disposed adjacent to at least one face of the four faces. A first assembly of the first puzzle and the second puzzle forms a cube, wherein in the first assembly, the first puzzle magnetically couples with the second puzzle.

In any embodiment, a first assembly of the first puzzle and the second puzzle may form a convex polyhedron, wherein in the first assembly, the first puzzle magnetically couples with the second puzzle.

In any embodiment, in the first assembly, the first puzzle and the second puzzle are in congruent configurations.

In any embodiment, for each of the first puzzle and the second puzzle, the plurality of magnets of every alternating polyhedron of the continuous loop may have a first polarity, and the plurality of magnets of every remaining polyhedron of the continuous loop may have an opposite second polarity.

In any embodiment, the convex polyhedron may be a cube.

In any embodiment, a second assembly of the first puzzle and the second puzzle may form a concave polyhedron, wherein in the second assembly, the first puzzle magnetically couples with the second puzzle.

In any embodiment, the concave polyhedron may be characterized by a hexagonal profile and six peaks.

In any embodiment, in the second assembly, the first puzzle and the second puzzle may not be in congruent configurations.

In any embodiment, a third assembly of the first puzzle and the second puzzle may form the concave polyhedron, wherein in the third assembly, the first puzzle and the second puzzle may be in congruent configurations, wherein in the third assembly, the first puzzle magnetically couples with the second puzzle.

In any embodiment, the six edges of each polyhedron may include (e.g., consist of) a first edge having an edge length of two units, a second edge and a third edge having an edge length of the square root of three units (√(3) units), a fourth edge and a fifth edge having an edge length of the square root of two units (√(2) units), and a sixth edge having an edge length of one unit.

In any embodiment, each polyhedron of the plurality of polyhedrons may have a tetrahedron shape.

In any embodiment, each polyhedron of the plurality of polyhedrons may be congruent with each other polyhedron of the plurality of polyhedrons.

In any embodiment, the plurality of polyhedrons may consist of twelve polyhedrons connected by the hinges in the continuous loop.

In any embodiment, the hinges may comprise bridging strips, each bridging strip extending from one polyhedron of the plurality of polyhedrons to an adjacent polyhedron of the plurality of polyhedrons.

In any embodiment, for each of the first puzzle and the second puzzle, each of the hinges may connect one of the six edges of one polyhedron of the plurality of polyhedrons to an identical edge of the six edges of another polyhedron of the plurality of polyhedrons.

In any embodiment, for each of the first puzzle and the second puzzle, each of the hinges may connect a first polyhedron of the plurality of polyhedrons to a second polyhedron of the plurality of polyhedrons such that a first face of the six faces of the first polyhedron is configured to reversibly abut a first face of the six faces of the second polyhedron, wherein the at least one magnet disposed adjacent to the first face of the first polyhedron has an opposite polarity to the at least one magnet disposed adjacent to the first face of the second polyhedron.

In any embodiment, for each of the first puzzle and the second puzzle, each of the hinges may connect the first polyhedron to the second polyhedron such that a second face of the six faces of the first polyhedron is configured to toggle about the bridging strip to abut a second face of the six faces of the second polyhedron, wherein the at least one magnet disposed adjacent to the second face of the first polyhedron has an opposite polarity to the at least one magnet disposed adjacent to the second face of the second polyhedron.

In any embodiment, for each of the first puzzle and the second puzzle, the first polyhedron may be connected by another bridging strip to a third polyhedron of the plurality of polyhedrons such that a third face of the six faces of the first polyhedron is configured to toggle about the another bridging strip to abut a fourth face of the six faces of the third polyhedron, wherein the at least one magnet disposed adjacent to the third face of the first polyhedron has an opposite polarity to the at least one magnet disposed adjacent to the fourth face of the third polyhedron.

In any embodiment, for each of the first puzzle and the second puzzle, the first polyhedron may be connected by the another bridging strip to third polyhedron such that a fourth face of the six faces of the first polyhedron is configured to toggle about the another bridging strip to abut a third face of the six faces of the third polyhedron, wherein the at least one magnet disposed adjacent to the fourth face of the first polyhedron has an opposite polarity to the at least one magnet disposed adjacent to the third face of the third polyhedron.

In any embodiment, for each of the first puzzle and the second puzzle, the first face of the first polyhedron may be congruent with the first face of the second polyhedron and the second face of the first polyhedron may be congruent with the second face of the second polyhedron.

BRIEF DESCRIPTION OF THE DRAWINGS

Non-limiting and non-exhaustive embodiments of the present disclosure are described with reference to the following figures, wherein like reference numerals refer to like parts throughout the various views unless otherwise specified.

DETAILED DESCRIPTION

The following disclosure describes kits which include at least two hinged magnetic puzzles (hereinafter referred to as puzzles for brevity). In any embodiment, each puzzle may have the same construction as the other puzzle(s) of the kit. Each puzzle is formed of hingedly connected polyhedrons, each of which has particular geometric characteristics. Further, each of the polyhedrons is hingedly connected to other polyhedrons of the puzzle and optionally has structural features which enable unique functionality and/or exhibit unique properties of the puzzle. The puzzle kits may include more than two puzzles, e.g., three, four, or more puzzles.

The puzzles of each kit have a number of solid polyhedral modules or bodies hingedly joined in a continuous loop. By executing different move sequences, the puzzles can be manipulated into many different configurations of visual and tactile interest. For example, the polyhedrons are configured to be manipulated about a ring axis of the continuous loop (i.e., turning the puzzle inside out) and/or toggled about hinging means (e.g., bridging strips) connecting adjacent polyhedrons. The specific geometry of the polyhedrons and the specific hinged relationships defined by the bridging strips enable the puzzles to be manipulated into numerous different geometric configurations. Moreover, a plurality of magnets having complementary polarities are disposed throughout the puzzle. Advantageously, said magnets stabilize the puzzle in numerous configurations and assemblies.

Figure 1A:
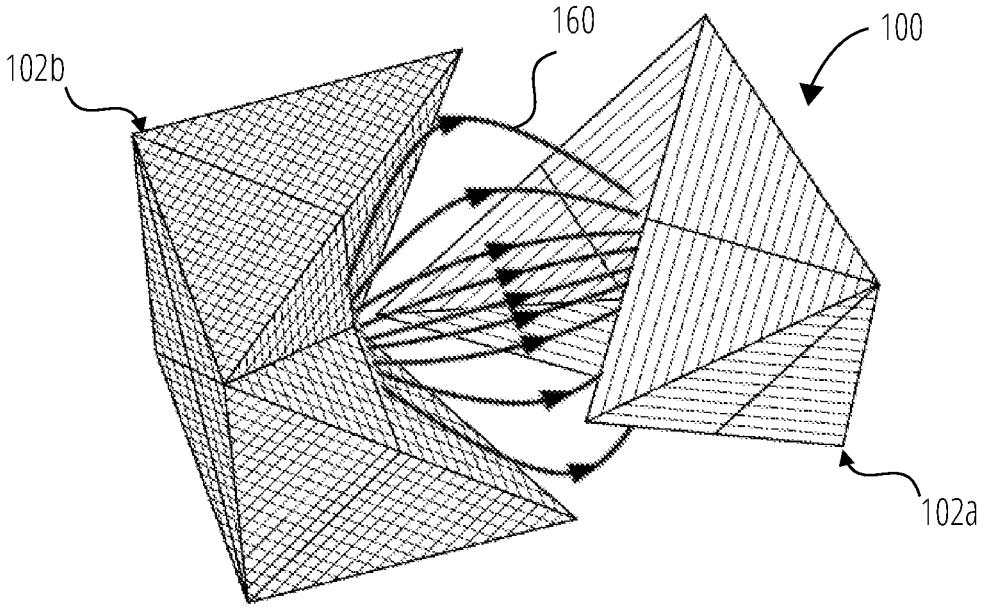
FIG. 1A illustrates a puzzle kit according to a representative embodiment of the present disclosure.

FIG. 1A illustrates a puzzle kit 100 (hereinafter, kit 100) according to a representative embodiment of the present disclosure. The kit 100 includes at least two magnetized puzzles 102*a*, 102*b*, each of which is formed of a plurality of polyhedrons connected by hinges in a continuous loop. In the embodiments described herein, the puzzles 102*a*, 102*b* are the same except in some embodiments for different surface treatments to impart a different appearance (as shown in FIG. 1A). That is, the construction, geometry, and dimensions of the puzzles 102*a*, 102*b* are the same. To assist with understanding, the puzzles 102*a*, 102*b* have different surface treatments; however, this is optional.

Each of the puzzles 102*a*, 102*b* can be independently configured into a multitude of configurations which are enabled by the geometry of the individual polyhedrons, the positioning of the hinges between the polyhedrons, and the position and polarity of magnets disposed within or upon the polyhedrons. Such details will be described below.

Uniquely, the specific geometry and hinge placement of each puzzle 102*a*, 102*b* enables the two puzzles 102*a*, 102*b* to be joined in assemblies which have a number appealing properties. For example, when the two puzzles 102*a*, 102*b* are manipulated by a user into the congruent convex polyhedral configurations shown in FIG. 1A (each being a nonahedron), the puzzles 102*a*, 102*b* can be rotated by ninety degrees relative to each other and then placed together to form the convex polyhedron of FIG. 1B.

Additionally, the placement and polarization of magnets in each of the puzzles 102*a*, 102*b* causes the mutual attraction of the puzzles 102*a*, 102*b*. This mutual attraction (represented by magnetic field 160) magnetically stabilizes the assemblies. Representative magnet placements are described below, and it shall be appreciated that the magnetic field 160 shown in FIG. 1A are representative and not intended to limit the placement or polarity of magnets within or upon puzzles 102*a*, 102*b*.

Figure 1B:
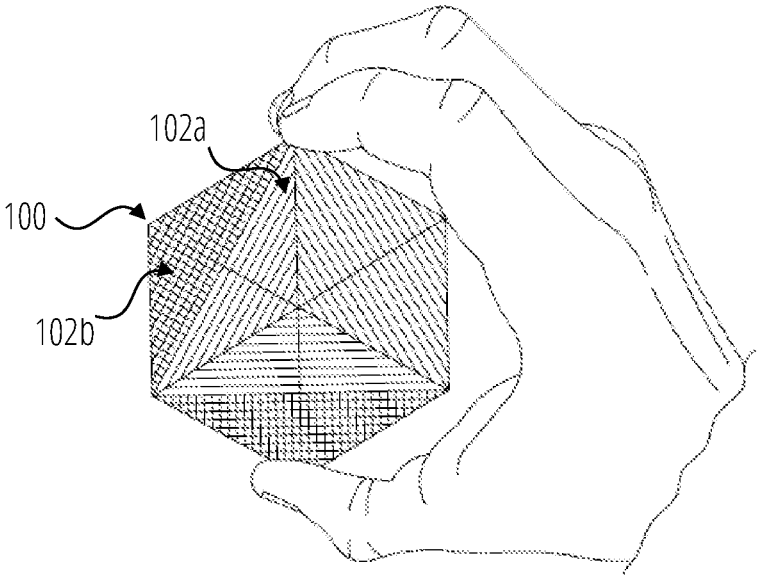
FIG. 1B illustrates the puzzle kit of FIG. 1A in a first assembly.

Referring to FIG. 1B, the puzzles 102*a*, 102*b* of FIG. 1A are joined together and magnetically stabilized in a first assembly which is a convex polyhedron, and more particularly, a cube. Not only does the cube assembly have a pleasing symmetry and density, but it is ideal for packaging the kit 100. As used herein, an "assembly" comprises two or more puzzles.

The kit 100 can be manipulated into numerous additional assemblies, a representative selection of which are described below. In some embodiments, a plurality of the puzzles can be combined to form a rhombic dodecahedron assembly. As will be appreciated, the kit 100 has the unique property that its puzzles may be configured into two assemblies which have a congruent shape, but wherein the individual puzzles in the first assembly have configurations that differ from the configurations of the puzzles in the second assembly. See FIG. 6A-FIG. 7D, described below.

Figure 2:
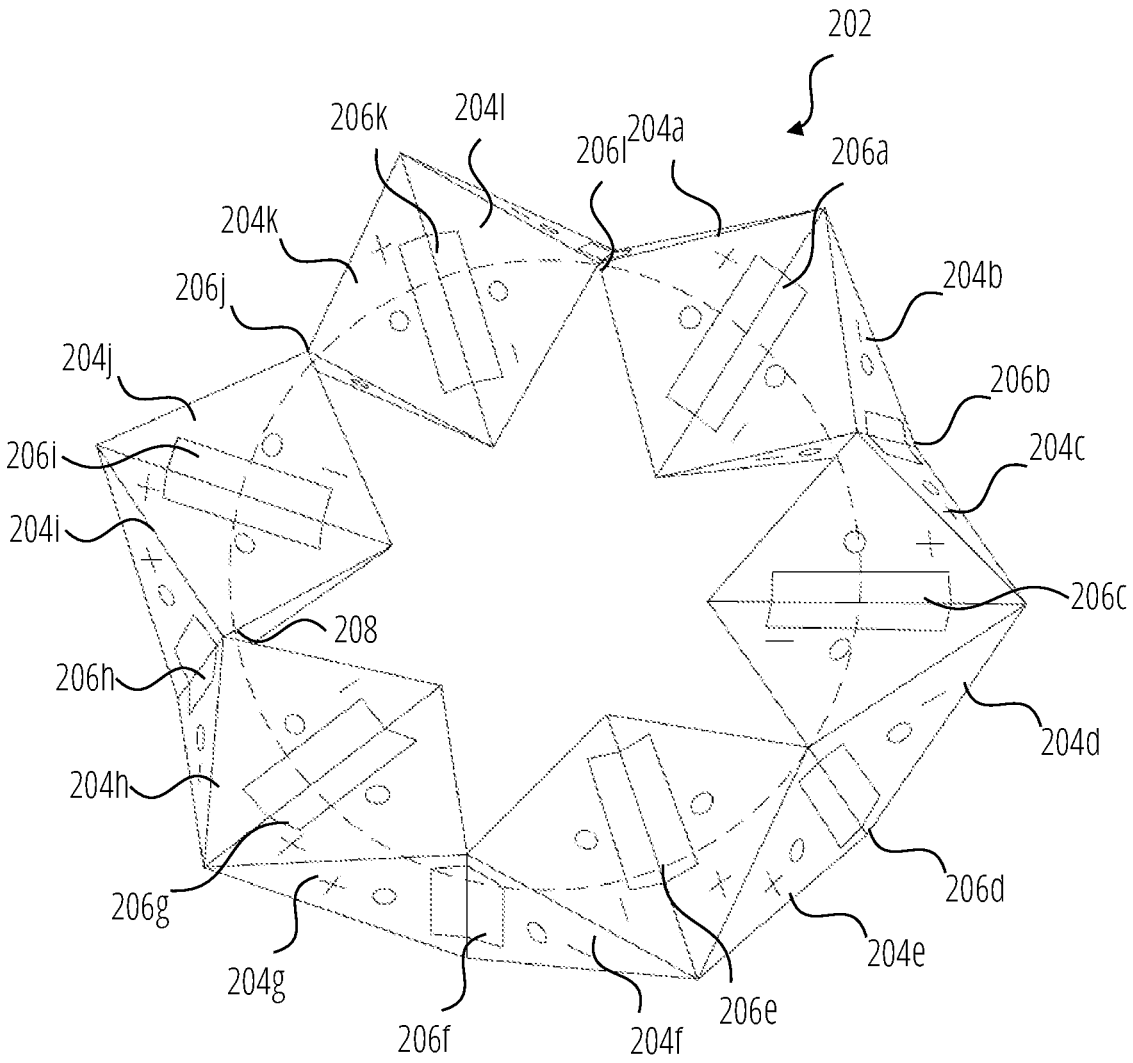
FIG. 2 illustrates a perspective view of a puzzle of a puzzle kit, according to a representative embodiment of the present disclosure.

FIG. 2 shows one transformational puzzle (hereinafter a puzzle 202) of a puzzle kit, e.g., the kit 100 of FIG. 1. The puzzle 202 is the same, i.e., has the same geometry, dimensions, and construction, as both puzzles 102*a*, 102*b* of the puzzle kit 100 of FIG. 1A.

The puzzle 202 includes a plurality of polyhedrons 204*a*-204*l* coupled together in a continuous loop around loop axis 208. Each of the polyhedrons 204*a*-204*l* is a solid body, optionally having a cavity formed therein, and may be formed from a thermoplastic polymer (e.g., PLA) or other rigid material. To clarify, the polyhedrons described herein are not limited to bodies which are completely solid. In some embodiments, one or more of the polyhedrons may be hollow (i.e., having a cavity therein) and may have one or more cut-outs from its volume.

The polyhedrons 204*a*-204*l* are hingedly coupled together in a series (e.g., a continuous loop) by hinges 206*a*-206*l* in an end-to-end configuration. As described below, each of the polyhedrons 204*a*-204*l* is provided with at least one magnet; together, the magnets stabilize the puzzle 202 in various configurations of visual and tactile appeal, such as the configuration detailed in FIGS. 4A-4D.

By manipulating the polyhedrons 204*a*-204*l*, the puzzle 202 may be positioned into numerous different configurations. The figures illustrate representative and non-limiting composite configurations into which the puzzle 202 may be manipulated, including various regular polyhedrons, irregular polyhedrons, convex polyhedrons, concave polyhedrons, and other polyhedron types.

To achieve the different configurations, the polyhedrons 204*a*-204*l* may be manipulated in different sequences comprising one or more of the following steps:

- rotating one or more polyhedrons 204*a*-204*l* about the loop axis 208 (which tends to turn the puzzle 202 "inside out");
- toggling one or more polyhedrons 204*a*-204*l* about the hinges 206*a*-206*l* such that different faces of polyhedrons 204*a*-204*l* abut each other; or
- translating one or more polyhedrons 204*a*-204*l* relative to each other.

Unlike known puzzles, the puzzle 202 of the present disclosure utilizes a unique combination of specific geometry and magnets that stabilize the puzzle 100 in myriad different shapes.

Specific features of the representative puzzle 202 will now be described.

Puzzle 202 is formed of a continuous loop of twelve hingedly connected identically-shaped (i.e., congruent) polyhedrons 204*a*-204*l*, wherein each polyhedron is a tetrahedron. Each polyhedron is hingedly connected to two adjacent polyhedrons along the loop axis 208 by two of the hinges 206*a*-206*l*, each hinge extending from one polyhedron to at least one of the adjacent polyhedrons. It shall be appreciated that the present disclosure is not limited to puzzles having twelve polyhedrons. In some embodiments, each of the polyhedrons 204*a*-204*l* is subdivided into two or more polyhedrons, resulting in twenty-four or thirty-six polyhedrons connected in the continuous loop by hinges.

As used herein, the term "congruent" means that two geometric figures (such as two polyhedrons of a single puzzle, or such as the overall shape of an assembly of two puzzles) are identical in shape and size. This includes the case when one of the geometric figures is a mirror image of the other.

Although each of the polyhedrons 204*a*-204*l* is congruent, the twelve polyhedrons include a first set of polyhedrons (i.e., polyhedrons 204*a, c, e, g, i, k*) having a first orientation and a second set of polyhedrons (i.e., polyhedrons 204*b, d, f, h, j, l*) having a different second orientation. Restated, if the first orientation of polyhedrons are represented as type "1," and the second orientation of polyhedrons are represented as type "2," then the polyhedrons 204*a*-204*l* are connected in the following sequence, beginning with polyhedron 204*a:* 1, 2, 1, 2, 1, 2, 1, 2, 1, 2, 1, 2.

The first orientation and the second orientation are mirror images of each other, such that the hinges 206*a*-206*l* each hingedly connect one edge of a polyhedron having the first orientation to an identical edge of another polyhedron having the second orientation. Accordingly, the hinges are disposed in two different types of locations (discussed below). Furthermore, the two hinges of each polyhedron are perpendicular to each other, which advantageously enables the puzzle 202 to achieve configurations having right angle, such as the configuration of FIG. 1A.

Figure 3:
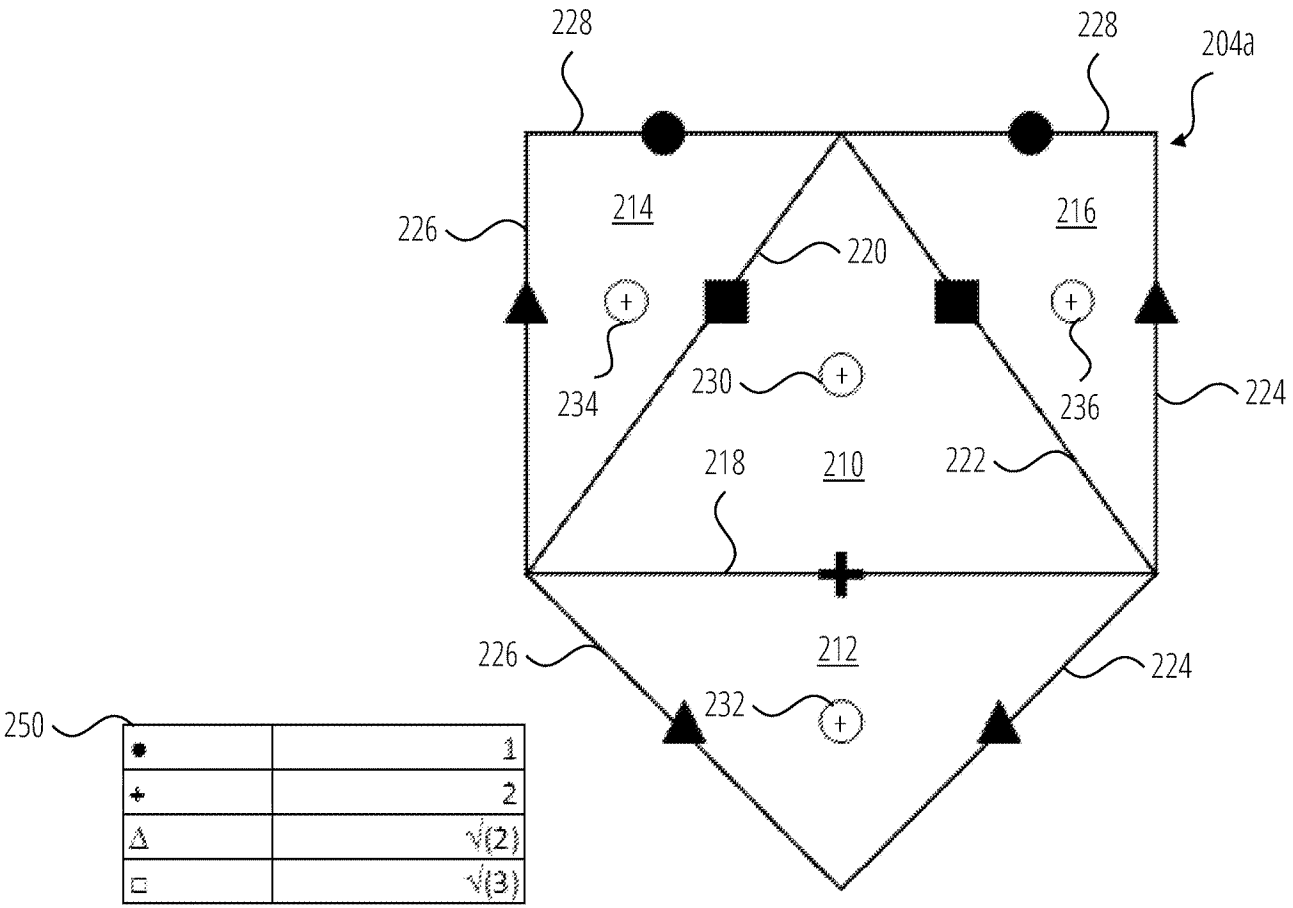
FIG. 3 is a schematic representation of the geometry of a polyhedron of the puzzle of FIG. 2.
Figure 4A:
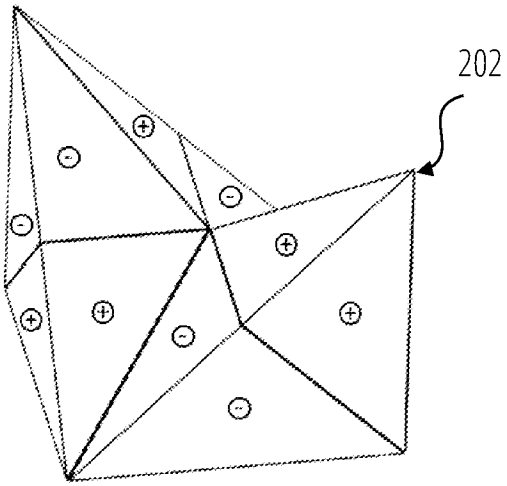
FIG. 4A illustrates a perspective view of the puzzle of FIG. 2 in a first configuration.
Figure 4D:
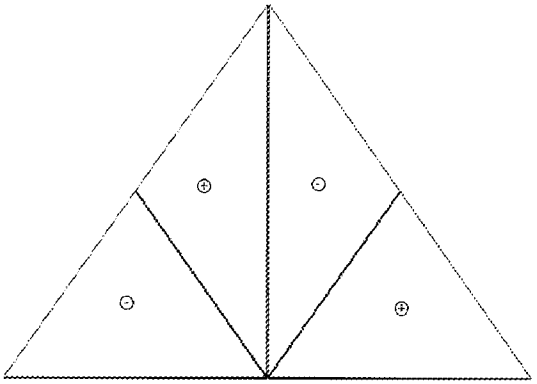
FIG. 4D illustrates a right elevation view thereof.
Figure 4B:
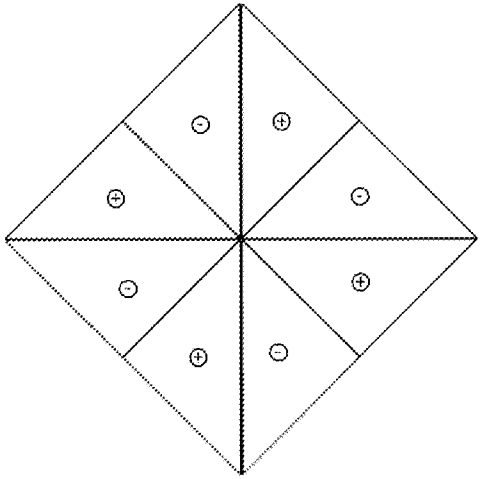
FIG. 4B illustrates a top plan view thereof.
Figure 4C:
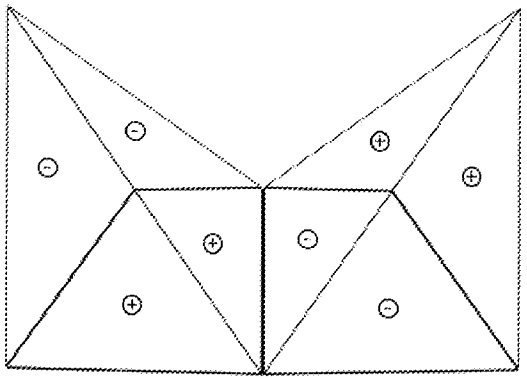
FIG. 4C illustrates a front elevation view thereof.
Figure 5A:
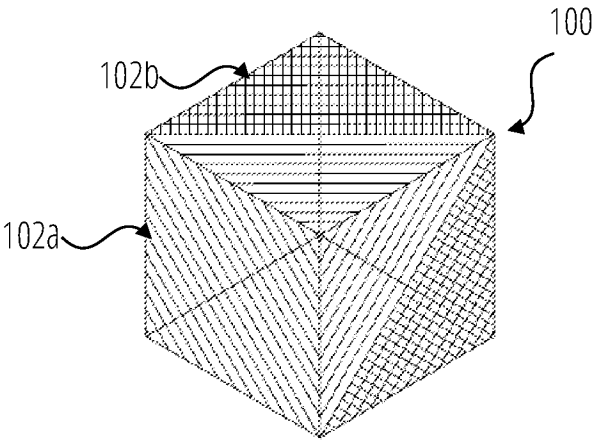
FIG. 5A illustrates a perspective view of the puzzle kit of FIG. 1A in a first assembly.
Figure 5B:
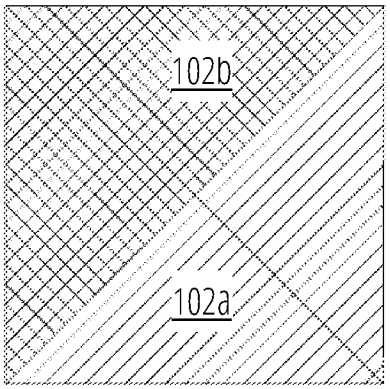
FIG. 5B illustrates a top plan view thereof.
Figure 5C:
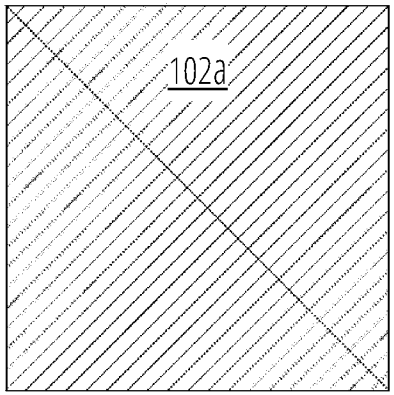
FIG. 5C illustrates a front elevation view thereof.
Figure 5D:
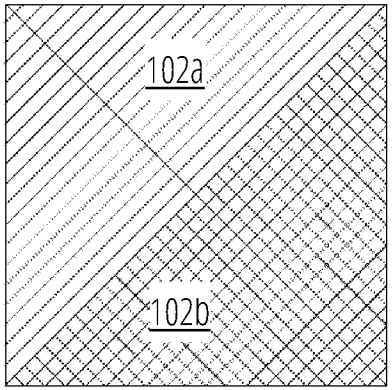
FIG. 5D illustrates a right elevation view thereof
Figure 6A:
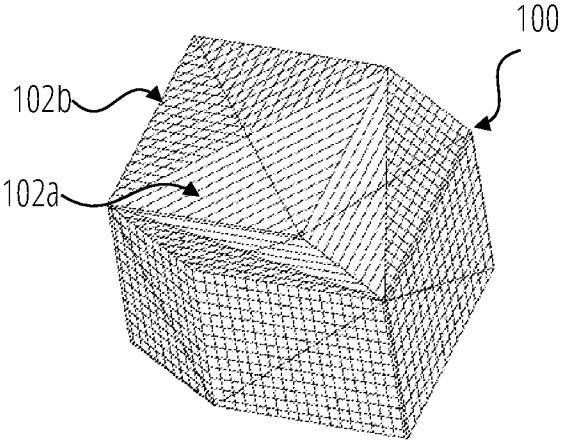
FIG. 6A illustrates a perspective view of the puzzle kit of FIG. 1A in a second assembly.
Figure 6D:
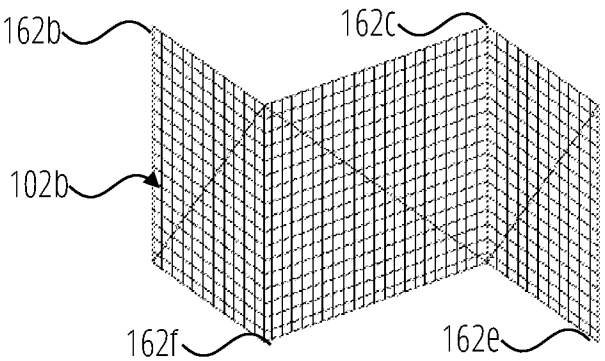
FIG. 6D illustrates a right elevation view thereof
Figure 6B:
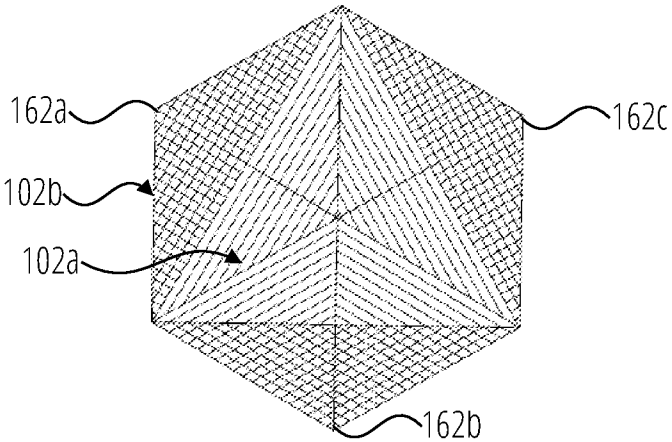
FIG. 6B illustrates a top plan view thereof.
Figure 6C:
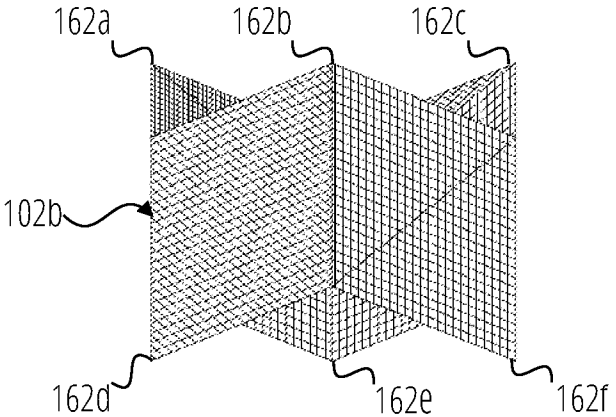
FIG. 6C illustrates a front elevation view thereof.
Figure 7A:
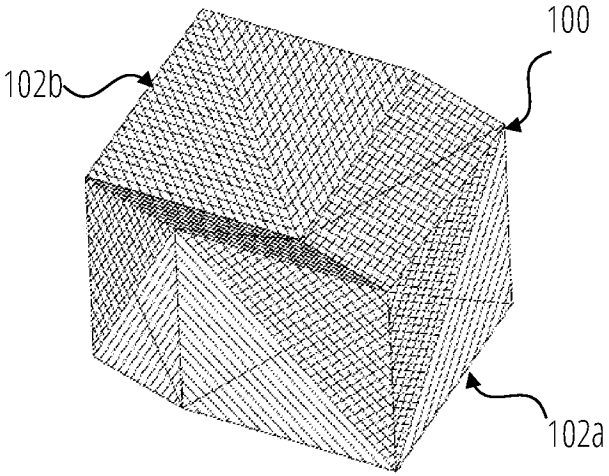
FIG. 7A illustrates a perspective view of the puzzle kit of FIG. 1A in a third assembly.
Figure 7B:
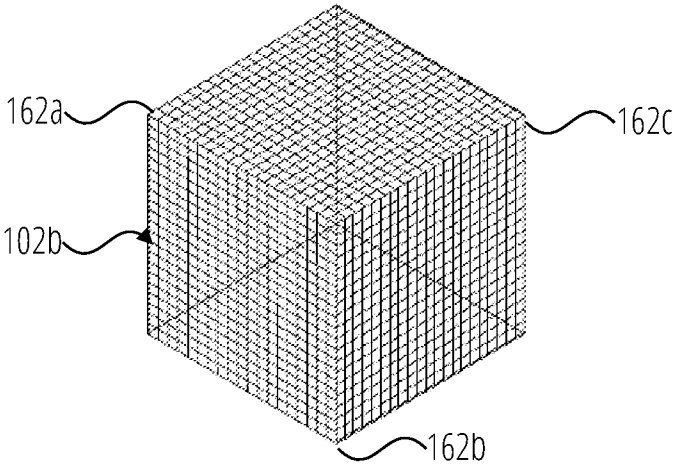
FIG. 7B illustrates a top plan view thereof.
Figure 7D:
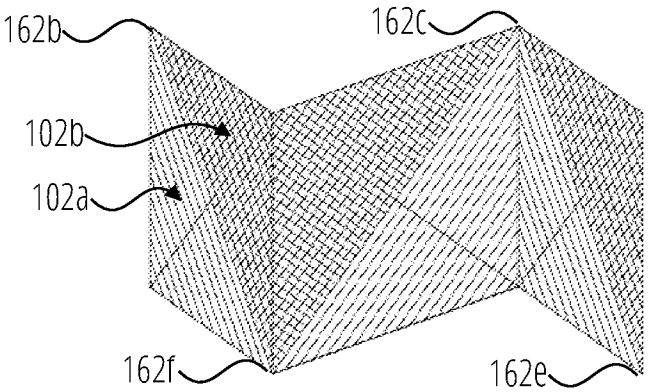
FIG. 7D illustrates a right elevation view thereof.
Figure 7C:
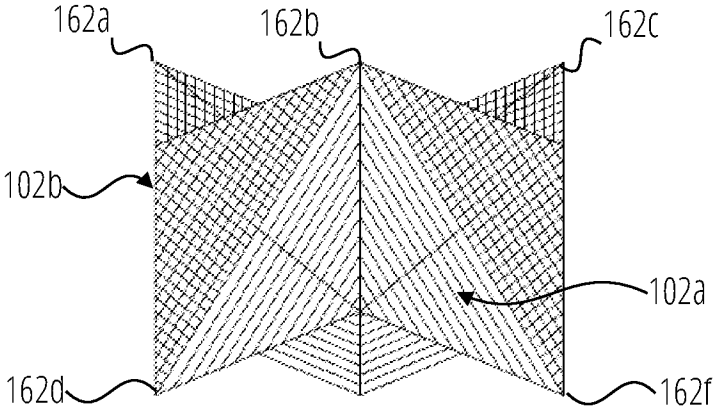
FIG. 7C illustrates a front elevation view thereof.

FIG. 3 is a two dimensional projection of one of the congruent polyhedrons 204*a* of FIG. 2 and describes the specific geometry thereof. The polyhedron has four faces 210, 212, 214, 216, and six edges 218, 220, 222, 224, 226, 228. The following edges form perpendicular edge pairs: edges 218 and 228, edges 224 and 228, and edges 226 and 228.

The relative lengths of each edge are dictated by legend 250. As a result of the edge length relationships defined by legend 250, the faces 212, 214, and 216 are right triangles, and the face 210 is an isosceles triangles (edge 220 and edge 222 have an equal length).

Legend 250 describes the relationship between different side lengths of the polyhedron. Edges labeled with the circle symbol "●" have a length of one unit, which may be scaled up or down in different embodiments. Regardless of the numerical value of the unit ("●"), the relative relationships between the different edges remain constant between different embodiments. Restated, regardless of the numerical value of the unit length "●," edges labeled with the plus symbol "+" have a length equal to 2 times the unit length, edges labeled with a triangle symbol "▲" have a length equal to the square root of two times the unit length (i.e., √(2)(unit length)), and edges labeled with a square symbol "■" have a length equal to the square root of three times the unit length (i.e., √(3)(unit length)).

With reference to legend 250, in a hypothetical embodiment where the unit length "●" equals 100 mm, the "●" edge (i.e., edge 228) has a length equal to 100 mm, the "+" edge (i.e., edge 218) has a length equal to 200 mm, each "▲" edge (i.e., edges 224, 226) has a length=100√(2) mm, and each "■" edge (i.e., edges 220, 222) has a length equal to 100√(3) mm. In any embodiment, the relative lengths of the six edges may be critical to the puzzle achieving the different configurations shown and described herein.

Referring back to FIG. 2, the puzzle 202 includes hinges 206*a*-206*l*, each of which connects two adjacent of the polyhedrons 204*a*-204*l*. The hinges 206*a*-206*l* flexibly join adjacent polyhedrons 204*a*-204*l*, enabling reversible toggling of the joined polyhedrons such that different faces selectively abut each other.

The hinges are positioned at two different types of locations. In a first type of location (exemplified by 206*a*, 206*c*, 206*e*, 206*g*, 206*i*, and 206*k*), the hinge flexibly joins the edges 218 of adjacent polyhedrons (which have a mirror image orientation relative to each other). In the second type of location (exemplified by hinges 206*b*, 206*d*, 206*f*, 206*h*, 206*j*, and 206*l*), the hinge flexibly joins the edges 228 of adjacent polyhedrons. Because edges 218 and 228 are perpendicular, successive hinges are also perpendicular to each other.

The foregoing hinging scheme enables a particular arrangement between adjacent polyhedrons. In particular, each hinge in the first type of location (i.e., between edges 218 of adjacent polyhedrons) hingedly connects a first polyhedron to an adjacent second polyhedron such that the face 210 of the first polyhedron is configured to reversibly abut the face 210 of the adjacent second polyhedron, and further such that the face 212 of the first polyhedron is configured to reversibly abut the face 212 of the adjacent second polyhedron. Further, each hinge in the second type of location (i.e., between edges 228 of adjacent polyhedrons) hingedly connects a first polyhedron to an adjacent second polyhedron such that the face 214 of the first polyhedron is configured to reversibly abut the face 216 of the adjacent second polyhedron, and further such that the face 216 of the first polyhedron is configured to reversibly abut the face 214 of the adjacent second polyhedron.

Each of polyhedrons 204*a*-204*l* is coupled to two adjacent polyhedrons. Specifically, each polyhedron is connected to one adjacent mirror image polyhedron at its edge 218 by a first hinge in the first type of location, and to another adjacent mirror image polyhedron at its edge 228 by a second hinge in the second type of location. In this way, each polyhedron can be toggled relative to each adjacent and hingedly coupled polyhedron.

In some embodiments such as the illustrated embodiment of FIG. 2, the hinges are arranged about the loop axis 208 of the polyhedron 204*a* in the same ordered sequence as the polyhedrons introduced above, i.e., in the first type location, in the second type location, in the first type location, and so on. In some embodiments, the hinges may be adhesive or tape-type bridging strips adhesively joined with adjacent faces of the polyhedrons.

Notwithstanding the representative hinges shown in FIG. 2, the hinges may take many different forms. In some embodiments, such as shown in FIG. 2, each of the hinges is a decal or sticker applied to the faces of at least two adjacent polyhedrons such that the hinge extends from one of the polyhedrons directly to another polyhedrons. Whereas each hinge of FIG. 2 connects two adjacent polyhedrons, in some embodiments, one or more hinges may connect more than two polyhedrons. For example, in some embodiments, a single continuous decal may be applied to more than two polyhedrons. Representative hinges of this configuration are detailed in U.S. Pat. Nos. 10,569,185 and 10,918,964 to Hoenigschmid, which are herein incorporated by reference in their entireties.

In other embodiments, the hinges are formed integrally with the polyhedrons (e.g., living hinges) and extend directly from one of the modules to an adjacent module. In such embodiments, the hinges may be formed as a flexible polymer strip of a same or similar material as the outer shell of the module. Representative hinges of this configuration are detailed in U.S. Pat. No. 11,358,070 to Aberg, which is herein incorporated by reference in its entirety.

In still other embodiments, the hinges are formed as one or more internal flexible connection strips (e.g., of a thin flexible polymer or textile) extending between adjacent modules and configured to be anchored within internal cavities of adjacent polyhedrons. Representative hinges of this configuration are detailed in PCT Publication No. WO 2022/130285 to Hoenigschmid, which is herein incorporated by reference in its entirety.

In any embodiment, more than one hinge may extend between adjacent edges of adjacent polyhedrons. The foregoing hinge structures are representative, not limiting.

Returning to FIG. 3, each polyhedron includes a plurality of magnets 230, 232, 234, 236 that are positioned and polarized such that each polyhedron is configured to magnetically couple with a plurality of other polyhedrons, thereby stabilizing the polyhedron 204*a* in any one or more of the configurations shown and described herein. In particular, at least one magnet is provided on or within each polyhedron at a location and with a polarity selected to magnetically couple with at least one magnet of an opposite polarity positioned on another polyhedron, e.g., when the puzzle 202 is manipulated into different configurations.

In the illustrated embodiment, at least one magnet of the plurality of magnets is disposed adjacent to each of the faces 210, 212, 214, 216 of the polyhedron, e.g., such that the magnetic field of each magnet extends through the adjacent face with sufficient force to magnetically couple with an alike magnet of opposite polarity disposed adjacent to an opposite surface of the face.

It shall be appreciated that the concept described herein is not limited to embodiments having four magnets. For example, in some embodiments, more than one magnet is disposed adjacent to each face such that each polyhedron has five, six, seven, or eight total magnets. In some embodiments, at least one face of each polyhedron is not provided with a magnet; in such embodiments, each polyhedron may have one, two, three, four, or more magnets. For example, in some embodiments, each polyhedron is provided with magnets 230, 234, 236, but not magnet 232. In some embodiments, each polyhedron is provided with magnets 230, 232, 234, but not magnet 236. In some embodiments, each polyhedron is provided with magnets 230, 232, 236, but not magnet 234. In some embodiments, each polyhedron is provided with magnets 232, 234, 236 but not magnet 230. In some embodiments, each polyhedron is provided with a single magnet. In some embodiments, at least one face of each polyhedron is not provided with a magnet and more than one magnet is provided adjacent to one of more other faces of the same polyhedron. Accordingly, in some embodiments, the puzzle 202 includes twelve, twenty-four, thirty-six, forty-eight, or more magnets.

In the illustrated embodiment, each magnet is embedded in each face, e.g., in a recess formed in the face itself. In other embodiments, each magnet may be disposed within an interior cavity of each polyhedron and positioned sufficiently near the relevant face such that the magnetic field of the magnet extends through said face. For example, in some embodiments, each magnet may be held within in a groove, slot, and/or track disposed within the cavity. In some embodiments, one or more of the magnets may be positioned within a cradle, such as a cradle disposed near a vertex of the edges of the polyhedron, such that the magnetic field from the magnet extends through more than one face of the polyhedron. Representative structures for securing magnets in polyhedrons are described in U.S. Pat. Nos. 10,569,185 and 10,918,964 and U.S. Patent Publication No. US 2022/0047960 to Hoenigschmid, which are hereby incorporated by reference in their entireties.

As noted above, the magnets are positioned and polarized such that each polyhedron is configured to magnetically couple with each of the two polyhedrons to which it is adjacently coupled by hinges. To achieve this, in some embodiments such as FIG. 2, the plurality of magnets of every other/alternating polyhedron in the continuous loop (e.g., the first, third, fifth, etc.) have a common polarity (e.g., negative), and the plurality of magnets of every remaining polyhedron in the continuous loop (e.g., the second, fourth, sixth, etc.) have a different polarity (e.g., positive). Restated, in some embodiments, for each of the first puzzle and the second puzzle, the plurality of magnets of every alternating polyhedron of the continuous loop have a first polarity, and wherein the plurality of magnets of every remaining polyhedron of the continuous loop have an opposite second polarity. Indeed, as shown in FIG. 3, each of the magnets 230, 232, 234, and 236 has a positive polarity; however, in other embodiments, all such magnets could be negative.

It is not necessary for every magnet of a single polyhedron to have a single common polarity. Rather, it is important that each magnet has an opposite polarity from the magnet(s) of the other polyhedrons to which it is configured to magnetically couple. The configuration in the previous paragraph is one representative configuration to achieve this. However, there are other configurations.

For example, in some embodiments such as described above, wherein each of the hinges connects a first polyhedron to a second polyhedron along the edge 218 such that the face 210 of the first polyhedron is configured to reversibly abut the face 210 of the second polyhedron, the magnet 230 disposed adjacent to the face 210 of the first polyhedron has an opposite polarity to the magnet 230 disposed adjacent to the face 210 of the second polyhedron. Optionally, in such embodiments, the magnet 232 disposed adjacent to the face 212 of the first polyhedron has an opposite polarity to the magnet 232 disposed adjacent to the magnet 232 of the second polyhedron.

In some embodiments such as described above, wherein each of the hinges connects a first polyhedron to a second polyhedron along the edge 228 such that the face 214 of the first polyhedron is configured to reversibly abut the face 216 of the second polyhedron and such that the face 216 of the first polyhedron is configured to reversibly abut the face 214 of the second polyhedron, the magnet 234 disposed adjacent to the face 214 of the first polyhedron has an opposite polarity to the magnet 236 disposed adjacent to the face 216 of the second polyhedron, and the magnet 236 disposed adjacent to the magnet 236 of the first polyhedron has an opposite polarity to the magnet 234 disposed adjacent to the face 214 of the second polyhedron.

The foregoing magnetic configurations may be combined in a single tetrahedron.

To illustrate one configuration which enables the puzzles of the puzzle kit to magnetically couple together, FIG. 4A-FIG. 4D show the puzzle 202 of FIG. 2 in a convex polyhedron configuration, which is the same nonahedron configuration shown in FIG. 1A.

As will be appreciated from FIG. 2, the puzzle 202 comprises twelve polyhedrons, each of which is provided with a plurality of magnets. The magnets shown in FIG. 4A-FIG. 4D are placed according to the diagram of FIG. 3. That is, each of the polyhedrons comprises at least one magnet disposed adjacent to each face thereof, and each magnet of each polyhedron has a same polarity. In the illustrated embodiment, successive polyhedrons are provided with magnets of opposite polarities.

As a result of the foregoing configuration, outermost surfaces the puzzle 202 include a number of magnets having mixed polarities. To magnetically couple two alike puzzles together in the manner shown in FIG. 1B, two alike puzzles 202 are provided. Each puzzle 202 is configured into the configuration of FIG. 4A-FIG. 4D. The puzzles 202 are respectively positioned as shown in FIG. 1A. One of the puzzles 202 may be rotated by one hundred eighty degrees such that the polarities of its magnets oppose the polarities of the corresponding magnets of the other puzzle. The puzzles 202 are then placed together and magnetically secured in the assembly of FIG. 1B.

FIG. 5A-FIG. 5D illustrate views of the kit 100 of FIG. 1B in the first assembly of the puzzles 102*a*, 102*b*, which is a convex polyhedron, and more particularly, a cubic hexahedron, i.e., or a cube. Each of the puzzles 102*a*, 102*b* has the nonahedron configuration detailed with respect to FIG. 4A-FIG. 4D.

FIG. 6A-FIG. 6D illustrate views of the kit 100 of FIG. 1B in a second assembly of the puzzles 102*a*, 102*b*. In the second assembly, the puzzle 102*a* is configured into a concave dodecahedron which is enclosed in a ring formed by the puzzle 102*b* (see hexagonal profile of FIG. 6B). In other words, in the second assembly, the first puzzle and the second puzzle are not congruent. The second assembly is itself a concave polyhedron characterized by a hexagonal profile (see FIG. 6B) and three primary peaks 162*a*-162*c* opposing three secondary peaks 162*d*-162*e*. In the second assembly, the puzzle 102*b* forms each of the six peaks 162*a*-162*d* because it encloses the circumferential surfaces of the puzzle 102*a*. In this second assembly, the magnets of puzzle 102*a* attract the magnets of adjacent faces of puzzle 102*b*, thereby magnetically stabilizing the kit 100.

FIG. 7A-FIG. 7D illustrate views of the kit 100 of FIG. 1B in a third assembly of the puzzles 102*a*, 102*b*. In the third assembly, each of the puzzles 102*a*, 102*b* are configured into a congruent concave polyhedron having a hexagonal profile (see FIG. 7B) and forming six peaks 162*a*-162*f* (only the peaks formed by puzzle 102*b* are shown in FIG. 7A-FIG. 7D). The puzzles 102*a*, 102*b* (in their congruent configurations) are rotated thirty degrees relative to each other and then placed together to achieve the third assembly. In this third assembly, the magnets of puzzle 102*a* attract the magnets of adjacent faces of puzzle 102*b*, thereby magnetically stabilizing the kit 100.

Notably, the second assembly and the third assembly are congruent. Accordingly, the kit 100 has the unique property of being able to achieve congruent assemblies utilizing puzzles having different configurations. This property adds the new functionality of being configurable into a same magnetically stabilized assembly of two or more puzzles in more than one way, presenting added challenge for the user.

It shall be appreciated that the foregoing advantages follow from the individual features and the unobvious combination of said features.

Representative embodiments of the invention can be implemented in many different forms and are not limited to the implementations described herein. On the contrary, the purpose of providing these embodiments is to make the disclosure of the present disclosure more thorough and comprehensive.

It should be noted that when an element is considered to be "connected" to another element, it may be directly connected to the other element or there may be a centered element at the same time. The terms "upper," "lower," "side," "vertical", "horizontal", "left", "right" and similar expressions used herein are for illustrative purposes only.

Unless otherwise defined, all technical and scientific terms used herein have the same meaning as commonly understood by those skilled in the technical field of the present disclosure. The terminology used in the description of the present disclosure herein is only for the purpose of describing specific embodiments and is not intended to limit the present disclosure. The term "and/or" as used herein includes any and all combinations of one or more related listed items.

What is claimed is:

1. A puzzle kit comprising a first puzzle and a second puzzle, each of the first puzzle and the second puzzle comprising:

a plurality of polyhedrons connected by hinges in a continuous loop, each polyhedron of the plurality of polyhedrons comprising:

four faces and six edges; and at least one magnet disposed adjacent to at least one face of the four faces, wherein a first assembly of the first puzzle and the second puzzle forms a cube, wherein in the first assembly, the first puzzle magnetically couples with the second puzzle and each of the first puzzle and the second puzzle are in congruent configurations, wherein a second assembly of the first puzzle and the second puzzle forms a concave polyhedron, wherein the first puzzle and the second puzzle are not in congruent configurations in the second assembly, wherein a third assembly of the first puzzle and the second puzzle forms the concave polyhedron, wherein the first puzzle and the second puzzle are in congruent configurations in the third assembly, wherein for each of the first puzzle and the second puzzle, the plurality of magnets of every alternating polyhedron of the continuous loop have a first polarity, and wherein the plurality of magnets of every remaining polyhedron of the continuous loop have an opposite second polarity.

2. The puzzle kit of claim 1, wherein the six edges of each polyhedron consist of a first edge having an edge length of two units, a second edge and a third edge having an edge length of the square root of three units ($\sqrt{(3)}$ units), a fourth edge and a fifth edge having an edge length of the square root of two units ($\sqrt{(2)}$ units), and a sixth edge having an edge length of one unit.

3. The puzzle kit of claim 1, wherein each polyhedron of the plurality of polyhedrons has a tetrahedron shape.

4. The puzzle kit of claim 1, wherein each polyhedron of the plurality of polyhedrons is congruent with each other polyhedron of the plurality of polyhedrons.

5. The puzzle kit of claim 1, wherein the plurality of polyhedrons consist of twelve polyhedrons connected by the hinges in the continuous loop.

6. The puzzle kit of claim 1, wherein the hinges comprise bridging strips, each bridging strip extending from one polyhedron of the plurality of polyhedrons to an adjacent polyhedron of the plurality of polyhedrons.

7. The puzzle kit of claim 1, wherein for each of the first puzzle and the second puzzle, each of the hinges hingedly connects one of the six edges of one polyhedron of the plurality of polyhedrons to an identical edge of the six edges of another polyhedron of the plurality of polyhedrons.

8. The puzzle kit of claim 1, wherein for each of the first puzzle and the second puzzle, each of the hinges hingedly connects a first polyhedron of the plurality of polyhedrons to a second polyhedron of the plurality of polyhedrons such that a first face of the six faces of the first polyhedron is configured to reversibly abut a first face of the six faces of the second polyhedron, wherein the at least one magnet of the first polyhedron comprises a first magnet disposed adjacent to the first face of the first polyhedron and the at least one magnet of the second polyhedron comprises a first magnet disposed adjacent to the first face of the second polyhedron.

9. The puzzle kit of claim 8, wherein for each of the first puzzle and the second puzzle, each of the hinges hingedly connects the first polyhedron to the second polyhedron such that a second face of the six faces of the first polyhedron is configured to toggle about the bridging strip to abut a second face of the six faces of the second polyhedron, wherein the at least one magnet of the first polyhedron comprises a second magnet disposed adjacent to the second face of the first polyhedron and the at least one magnet of the second polyhedron comprises a second magnet disposed adjacent to the second face of the second polyhedron.

10. The puzzle kit of claim 9, wherein for each of the first puzzle and the second puzzle, the first polyhedron is connected to a third polyhedron of the plurality of polyhedrons such that a third face of the six faces of the first polyhedron is configured to abut a fourth face of the six faces of the third polyhedron, wherein the at least one magnet of the first polyhedron comprises a third magnet disposed adjacent to the third face of the first polyhedron and the at least one magnet of the third polyhedron comprises a first magnet disposed adjacent to the fourth face of the third polyhedron.

11. The puzzle kit of claim 10, wherein for each of the first puzzle and the second puzzle, the first polyhedron is connected to the third polyhedron such that a fourth face of the six faces of the first polyhedron is configured to abut a third face of the six faces of the third polyhedron, wherein the at least one magnet of the first polyhedron comprises a fourth magnet disposed adjacent to the fourth face of the first polyhedron and the at least one magnet of the third polyhedron comprises a second magnet disposed adjacent to the third face of the third polyhedron.

12. The puzzle kit of claim 9, wherein for each of the first puzzle and the second puzzle, the first face of the first polyhedron is congruent with the first face of the second polyhedron and wherein the second face of the first polyhedron is congruent with the second face of the second polyhedron.

13. The puzzle kit of claim 1, wherein the concave polyhedron has a hexagonal profile with six peaks.

14. A puzzle kit comprising a first puzzle and a second puzzle, each of the first puzzle and the second puzzle comprising:

a plurality of polyhedrons hingedly connectable by hinges in a continuous loop, each polyhedron of the plurality of polyhedrons comprising:

four faces and six edges, wherein each edge of the six edges has a relative side length of one unit, two units, the square root of two units (√(2) units), or the square root of three units (√(3) units); and a plurality of magnets, wherein the four faces each have at least one magnet of the plurality of magnets disposed adjacent thereto, wherein a first assembly of the first puzzle and the second puzzle forms a convex polyhedron, wherein in the first assembly, the first puzzle magnetically couples with the second puzzle, wherein a second assembly of the first puzzle and the second puzzle forms a concave polyhedron, wherein in the second assembly, the first puzzle magnetically couples with the second puzzle and the first puzzle and the second puzzle are not in congruent configurations, wherein a third assembly of the first puzzle and the second puzzle forms the concave polyhedron, wherein in the third assembly, the first puzzle and the second puzzle are in congruent configurations and the first puzzle magnetically couples with the second puzzle.

15. The puzzle kit of claim 14, wherein the six edges of each polyhedron consist of a first edge having an edge length of two units, a second edge and a third edge having an edge length of the square root of three units (√(3) units), a fourth edge and a fifth edge having an edge length of the square root of two units (√(2) units), and a sixth edge having an edge length of one unit.

16. A puzzle kit comprising a first puzzle and a second puzzle, each of the first puzzle and the second puzzle comprising:

a plurality of polyhedrons hingedly connectable by hinges in a continuous loop, each polyhedron of the plurality of polyhedrons comprising:

four faces and six edges, wherein each edge of the six edges has a relative side length of one unit, two units, the square root of two units (√(2) units), or the square root of three units (√(3) units); and a plurality of magnets, wherein the four faces each have at least one magnet of the plurality of magnets disposed adjacent thereto, wherein a first assembly of the first puzzle and the second puzzle forms a convex polyhedron, wherein in the first assembly, the first puzzle magnetically couples with the second puzzle, wherein a second assembly of the first puzzle and the second puzzle forms a concave polyhedron, wherein in the second assembly, the first puzzle magnetically couples with the second puzzle, wherein the concave polyhedron is characterized by a hexagonal profile and six peaks.

17. The puzzle kit of claim 16, wherein in the first assembly, the first puzzle and the second puzzle are in congruent configurations.

18. The puzzle kit of claim 16, wherein for each of the first puzzle and the second puzzle, the plurality of magnets of every alternating polyhedron of the continuous loop have a first polarity, and wherein the plurality of magnets of every remaining polyhedron of the continuous loop have an opposite second polarity.

19. The puzzle kit of claim 16, wherein the convex polyhedron is a cube.

* * * * *